US005579619A

United States Patent [19]

Godschalx

[11] Patent Number: 5,579,619

[45] Date of Patent: Dec. 3, 1996

[54] STRUCTURE AND METHOD OF REDUCING UPLIFT OF AND SCOURING ON MEMBRANE ROOFS

[75] Inventor: Raymond D. Godschalx, Rancho Cucamonga, Calif.

[73] Assignee: Building Materials Corporation of America, Wayne, N.J.

[21] Appl. No.: 316,595

[22] Filed: Sep. 30, 1994

[51] Int. Cl.[6] ..... E04D 5/12

[52] U.S. Cl. ..... 52/409; 52/410; 52/746.11

[58] Field of Search ..... 52/408, 409, 410, 52/411, 412, 413, 746.11, 741.4

[56] References Cited

U.S. PATENT DOCUMENTS

| | | | |
|---|---|---|---|
| 3,135,069 | 6/1964 | Schuller et al. | 52/411 X |
| 3,817,009 | 6/1974 | Elder | 52/173 |
| 4,080,228 | 3/1978 | Currigen | 52/746 |
| 4,223,486 | 9/1980 | Kelly | 52/1 |
| 4,409,761 | 10/1983 | Bechtel | 52/1 |
| 4,557,081 | 12/1985 | Kelly | 52/94 |
| 4,583,337 | 4/1986 | Kramer et al. | 52/302 |
| 4,608,792 | 9/1986 | Gerber | 52/199 |
| 4,677,800 | 7/1987 | Roodvoets | 52/309.12 |
| 4,712,349 | 12/1987 | Riley et al. | 52/408 |
| 4,870,796 | 10/1989 | Hart et al. | 52/409 |
| 4,873,807 | 10/1989 | Filip | 52/741.4 |
| 4,888,930 | 12/1989 | Kelly | 52/410 |
| 4,926,596 | 5/1990 | Yeamans | 52/408 |
| 5,167,579 | 12/1992 | Rotter | 454/365 |
| 5,392,576 | 2/1995 | Yeamans | 52/408 |

OTHER PUBLICATIONS

Thomas E. Phalen, Jr. *Design and Analysis of Single–Ply Roof Systems*, Chapter 6, pp. 248–287 (1993).

H. J. Gerhardt and C. Kramer, "Wind Safety of Single–Ply Roofs Under Time Varying Wind Load," *Journal of Wind Engineering and Industrial Aerodynamics*, 41–44 (1992) 1513–1524.

Jorge Pardo, "Wind Performance Limits of Roof Ballast Pavers," *Journal of Wind Engineering and Industrial Aerodynamics,* 36 (1990) 689–698.

Advertisement of Greenstreak for Yellow Spaghetti dated Nov. 1992 (2 pages).

Flyer of Greenstreak for Yellow Spaghetti, (2 pages).

*Primary Examiner*—Carl D. Friedman
*Assistant Examiner*—W. Glenn Edwards
*Attorney, Agent, or Firm*—Seidel, Gonda, Lavorgna & Monaco, P.C.

[57] ABSTRACT

A roof structure and method for reducing uplift on a roof resulting from a wind blowing over the roof at a rooftop wind speed. The roof has a membrane overlying a deck. An air permeable and resilient mat is installed over the membrane. The mat has openings of a size to reduce the wind velocity passing through it to the membrane while the openings being of a size that the mat is not lifted by a pressure differential therein reducing uplift on the membrane.

14 Claims, 6 Drawing Sheets

STRUCTURE AND METHOD OF REDUCING UPLIFT OF AND SCOURING ON MEMBRANE ROOFS

FIELD OF THE INVENTION

This invention relates generally to the field of membrane roofs which are commonly referred to as flat roofs or low sloped roofs and, more particularly, to a structure and method of reducing the uplift of the membrane and the scouring of any aggregate layer on the membrane caused by wind forces.

BACKGROUND OF THE INVENTION

The roof is a major portion of the surface area in building structures, accounting for as much as 40% of the surface area. The most common roof style for high-rise and industrial buildings and row homes is the flat or low sloped roof. Although nominally flat, the roof usually has a slight slope or pitch to improve drainage.

A low sloped roof comprises at a minimum a deck and a waterproof membrane. An insulation layer can be installed between the deck and the membrane, if desired.

There are two basic categories of low sloped roof construction. The conventional technique is the built-up roof system (BUR), in which layers of felt and bitumen are layered to form a membrane. A layer of gravel or a coating is placed on top to protect the membrane from ultraviolet rays. The second and more recent construction is the single-ply roofing system (SPM), in which a single elastomeric sheet overlies the deck.

The primary purpose of a roof is to separate the exterior atmosphere from the interior of the building, and maintain the integrity of that separation during expected extremes of ambient weather conditions throughout a reasonable lifetime. This requirement leads to several design factors, which include: (1) external and internal temperatures; (2) external moisture, air moisture, rain, snow, sleet and hail; (3) wind uplift of the membrane; (4) impact resistance to weather and other effects such as dropped tools and walking; (5) the esthetics of the roof; and (6) influence of solar radiation and ultraviolet rays.

Of these design criteria, the ability of the roof to withstand the effect of the wind is one of the more critical factors in low sloped roofs. The wind can cause the uplift billowing of the membrane resulting in failure, the scattering of ballast, and even catastrophic roof failure in extreme situations. However, the present methods of preventing wind uplift share one or more shortcomings, as described below.

One of the most common methods of countering uplift forces on a single-ply roofing system is the use of stone ballast. In such a method, the waterproofing membrane is completely covered with a uniform layer of stone aggregate (usually ¾" to 2½" diameter in size), at layer depth to produce a down-load pressure of approximately 10 pounds per square foot. The substantial weight of this aggregate must be factored into the design of the building as added load to the roof and support structure. However, the main problem with stone ballast is that strong wind forces often cause the aggregate stones to shift position, clustering in some areas and leaving other areas uncover. This phenomena is referred to as scouring. Where the migration of the aggregate results in areas that are clear of ballast the membrane can billow upward from the aerodynamic lift of the wind, resulting in the membrane becoming damaged or disengaged. In some instances, uplift and billowing will cause ballast to be propelled from the rooftop, resulting in potential damage or injury to property or persons.

Another single-ply roofing system involves mechanically affixing the waterproofing membrane and underlying insulations to the deck with fasteners, which transfer the uplift load to the deck. In a majority of commercial and industrial buildings, the deck is formed of corrugated steel of 18 to 22 gauge thickness. Decks may also be formed from wood, concrete, gypsum and other suitable materials. The fasteners experience lateral and vertical loads induced by wind uplift forces, including the oscillating loads of membrane billowing and deck flutter. This causes the fasteners to become disengaged, ultimately backing out and leaving the membrane unsecured. A backed-out fastener has a free end capable of puncturing of the waterproofing membrane, which results in moisture having direct access to the structural deck and corroding the structural steel. Additionally, when the fasteners become disengaged, the membrane billowing can increase the forces acting on the membrane seams, therein resulting in seam failure.

Another securement system used for a single-ply roofs is to fully adhere the waterproofing membrane to the top surface of a subcomponent which has been mechanically affixed to the roof deck. In this method, the membrane becomes part of the subcomponent which is subject to pressure differentials and resultant forces between the inside and outside of the structure. The subcomponents must be mechanically affixed to the structural deck by fasteners to resist uplift forces. The adhesive bond between waterproofing membrane and subcomponent top surface is subjected to shear forces as a result of expansion and contraction of the membrane. The subcomponent structure, usually layers of insulating materials, is sensitive to moisture and condensation, permitting separation of subcomponent's top surface at the interface of the adhesive bond with the membrane. The adhesives are also sensitive to moisture and temperature. An adhesive bond failure results in the loss of membrane securement.

The built-up roof system has problems similar to the fully adhered single-ply roof, in that the built-up layers of felt are secured by bitumen (asphalt). The layers can delaminate, and chunks of asphalt/felt can be blown off the roof. The built-up roof system also shares the problem of gravel scouring with the single-ply roofing system.

One method of reducing uplift in situations where insulation panels are installed on top of the membrane is disclosed in U.S. Pat. No. 4,583,337, which teaches installing corrugated cover members along the periphery of the roof overlying insulation panels. The corrugated cover members purport to create a vacuum under the cover members by the wind flowing around the cover members. The differential pressure created by the vacuum pulls the cover members downward to retain the insulation elements.

U.S. Pat. No. 4,926,596 discloses an apertured overlay that is stretched over the membrane. The apertured overlay is secured at the periphery of the roof, and allows wind to pass through to the membrane. The overlay physically restrains the waterproof membrane from bellowing.

From the above problems and attempts to alleviate them, it is apparent that there is a desire to have a structure and/or method of reducing uplift on the membrane, and of limiting scouring of ballast.

SUMMARY OF THE INVENTION

This invention relates to a roof structure for and method of reducing uplift resulting from wind blowing over the roof, and retaining ballast in position. The roof has a waterproof membrane overlying a deck, and an air permeable and resilient mat is installed over the membrane. The mat has a random convoluted mesh of a size which breaks up the laminar flow of wind velocity passing over and it while permitting pressure equalization down to the membrane so that the mat is not lifted away from the membrane.

One object, feature and advantage resides in the air permeable and resilient mat overlying the ballast, if provided, to prevent scouring of the ballast.

Another object, feature and advantage resides in the air permeable and resilient mat being adhered in a grid pattern to retain ballast, if provided, in the ballast respective grid.

In a preferred embodiment, the waterproof membrane overlays a decking and is secured at the periphery of the roof. A layer of ballast overlies the membrane and is cleared in section to secure the air permeable and resilient mat by an adhesive. The mat reduces uplift on the membrane.

In the preferred embodiment, the mat is constructed of synthetic fibers randomly aligned into a web and bonded together at their intersections, forming a relatively rigid mat having significant porous area between the random fibers to disrupt and diffuse the wind over the membrane.

Further objects, features and advantages of the present invention will become more apparent to those skilled in the art as the nature of the invention is better understood from the accompanying drawings and detailed description.

BRIEF DESCRIPTION OF THE DRAWINGS

For the purpose of illustrating the invention, the drawings show a form which is presently preferred; it is being understood, however, that this invention is not limited to the precise arrangement and instrumentalities shown.

DETAILED DESCRIPTION OF THE INVENTION

Figure 1:
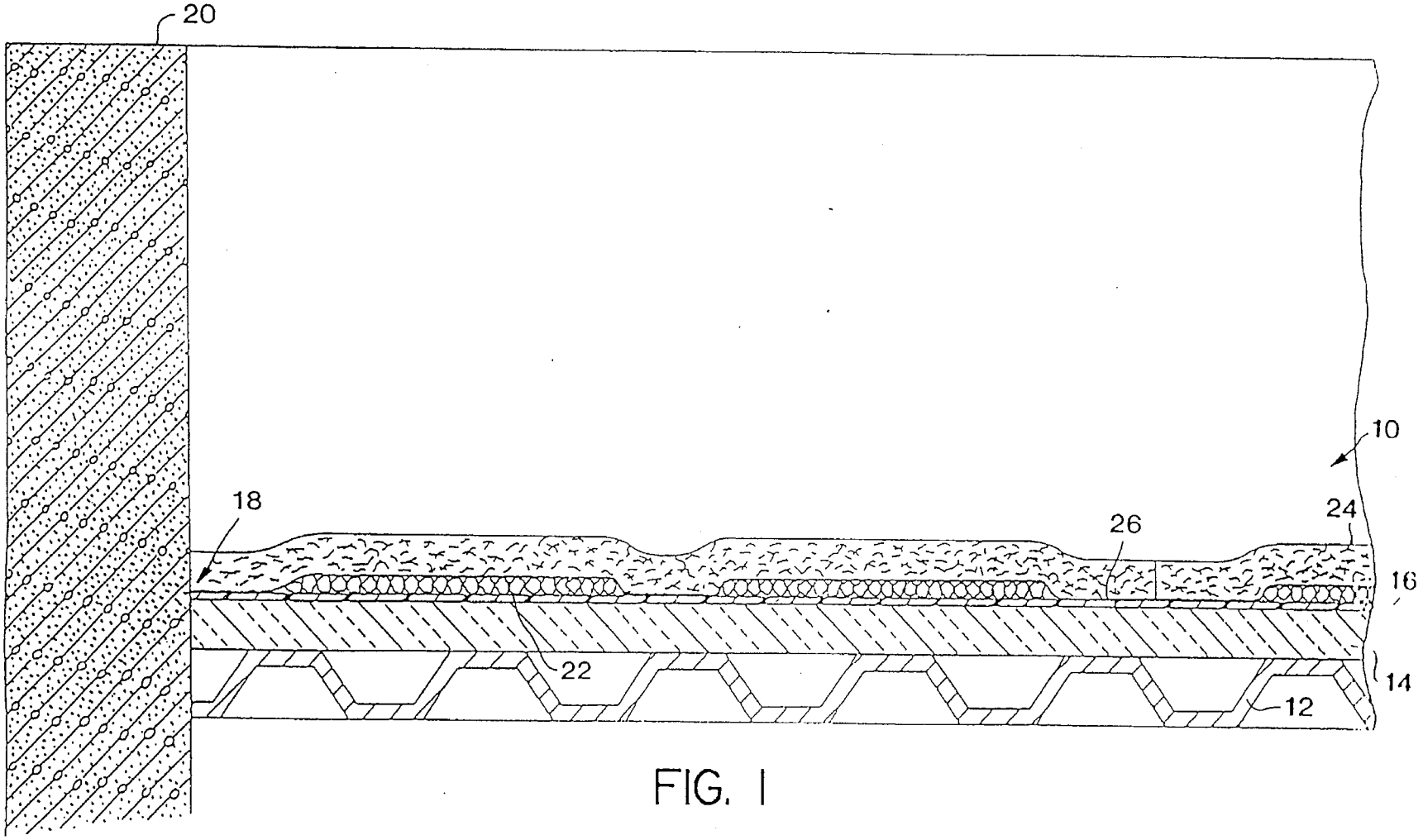
FIG. 1 is a cross-sectional view of a single-ply ballasted roof of this invention.

Referring to the drawings in detail, where like numerals indicate like elements, and prime (' and ") indicate counterparts of such elements, there is illustrated in FIG. 1 a roof structure 10 according to the invention.

Referring to FIG. 1, the roof structure 10 has a roof decking 12. The roof structure 10 has an insulation layer 14 overlying the roof decking 12. The insulation 14 is laid on the roof decking 12; no fasteners are used to secure the insulation 14 to the roof decking 12. The roof 10 has at a periphery 18 of the roof decking 12 a parapet 20. In a preferred embodiment, the roof structure 10 has a single-ply waterproof membrane 16. The single-ply membrane 16 is secured at the periphery 18 of the roof deck 12 in proximity to the parapet 20 by conventional methods. The single-ply membrane 16 is not secured except at the periphery 18 and simply overlies the insulation 14. The single-ply membrane 16 is formed in sheets. The sheets are bonded together by heat welding, solvent welding or adhesives, to form a larger sheet if required to cover the entire roof. Overlying the single-ply membrane 16 is a layer of aggregate 22. The size of the aggregate ballast 22 is ⅜ of an inch nominal diameter gravel. This is in contrast to prior art ballasted single-ply roofs which require #4 river rock (2" to 2½" diameter). The aggregate ballast is applied at a rate sufficient to overcome calculated uplift forces cause by wind and internal building pressures. The rate application per square is less than a typical rate of 10 pounds per square for conventional construction. A square is 100 square feet and is a common term in roofing. The above construction is conventional and well known, with the exception of the size of the aggregate ballast 22 and the pounds per square of aggregate ballast 22.

The roof 10 of the preferred embodiment has an air permeable and resilient mat 24 overlying the aggregate 22. The air permeable and resilient mat 24 in the preferred embodiment is a nonwoven air permeable and resilient mat made of synthetic fibers (usually nylon, PVC or polyester) which are opened and blended, then randomly aligned into a web by air flow. The web is treated with binding agents of water based phenolics and latexes. The treated web is then oven cured to bind the fabrics into relatively rigid mat having significant porous area between the random fibers. U.S. Pat. No. 5,167,579 describes an air permeable and resilient mat being used in conjunction with a ridge vent of a sloped roof and is incorporated herein by reference.

In a preferred embodiment, the mat 24 has a thickness of ⅜ of an inch. The mat 24 comes in rolls 78 inches wide and 60 yards long. The mat 24 weighs 11.11 pounds per square (1.8 oz./ft$^2$) and has a percent open area of 65.

Figure 2:
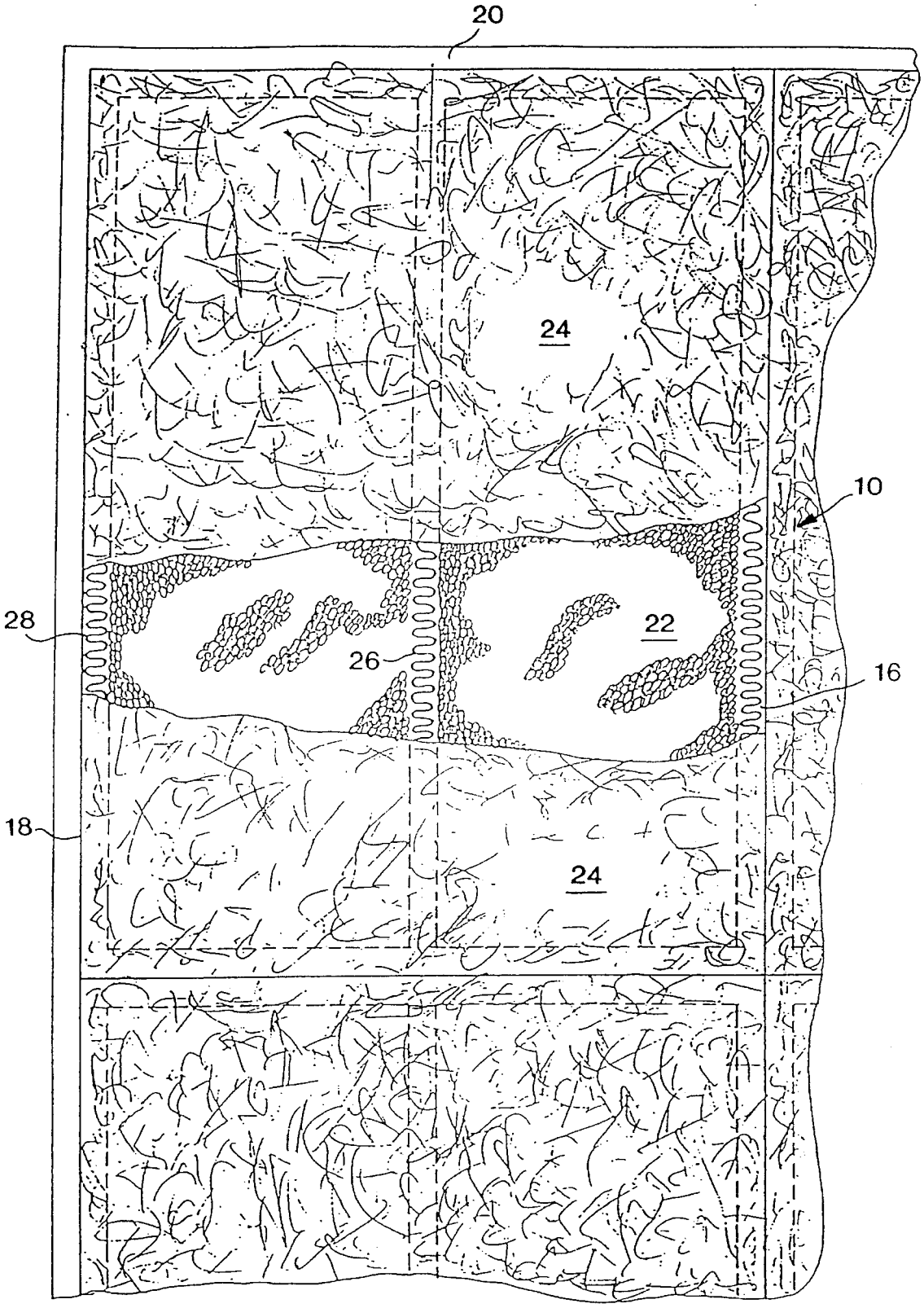
FIG. 2 is a top view of the single-ply ballasted roof of FIG. 1 with portions broken away.

Referring to FIG. 2, the air permeable and resilient mat 24 is secured to the roof 10 by clearing away aggregate 22 in sections of the roof 10. It has been found that if a 3 inch strip of the membrane 16 associated with the periphery of the mat and a 3 inch strip down the center line of the length are cleared of aggregate 22 on the membrane, the area is sufficient to secure the mat. An adhesive, such as PLIOBOND® 5403 Walkway Pad Adhesive sold by Ashland Chemical, or a neoprene cement 26 is used to secure the air permeable and resilient mat 24 to the single-ply membrane 16.

The mat 24 is secured to the membrane 16 to prevent the mat 24 from being pushed across the roof 10. Moreover, as seen in FIG. 2, where the 3 inch strip adhesive region 28 are shown in hidden line, the mats 24 are held in a grid pattern. The aggregate ballast 22 is retained in its respective grid. In addition as discussed below, the mat reduces the wind speed across the ballast 22. Small gaps in the adhesive are positioned to allow water to flow from grid to grid in order to drain properly.

Theory Behind Wind Uplifts

In the designing of a roof, the pressure differential on the membrane has to be determined. However, in the design of the roofs, not only average day basic wind speed has to be considered, but winds associated with hurricanes and thunderstorms and Foehnlike winds need also to be considered. Therefore, tables, charts and equations are required to determine the maximum uplift force on the membrane. One of the items that has to be determined is the basic wind speed ($V_o$). The speed of the wind is constantly changing. Therefore, the basic wind speed ($V_o$) is the average wind speed over time.

The speed of the wind at the roof top ($V_R$) is calculated as a function of the basic wind speed ($V_o$), the height above the ground the roof is located (basic wind speed ($V_o$) is typically measured at 32.8 feet (10 m)), and the type of terrain in the area. There are numerous theories on how to determine roof top wind speed ($V_R$) including methods from the Uniform Building Code, ANSI Standards, and Factory Mutual Standards, Standard Building Code. These theories each achieve different results but the underlying equation is the same and is $V_R=AV_o^mH^n$. The constant "A" and exponent "n" are functions of ground roughness. The exponent "m" is a power constant and typically about 1.0.

Typically, the wind speed on the roof surface ($V_S$) is greater than the roof top wind speed ($V_R$). The roof top wind speed is determined by the local wind speed as described above. Roof top wind speed is the speed of the wind at that height of the roof and does not include the change of wind speed because of the interaction with the roof.

Using Bernoulli's equation $$P_R/\gamma+V_R^2/2g=P_S/\gamma+V_S^2/2g$$

where $P_R$ is the air pressure roof top level and $P_S$ is the air pressure on the roof's surface, the equation is rearranged to achieve a dimensionless coefficient of pressure $$C_P=\Delta p(2g)/\gamma V^{2R}.$$

Therefore, substituting $C_p$ into the equation results in $V_S=V_R(1-C_p)^{0.5}$. It is this pressure differential that exerts a force on the membrane causing the membrane to lift. Since the volume of wind having to pass over the roof includes a portion of the wind that would have typically passed through the space occupied by the building, the velocity over the roof ($V_S$) must be greater than the roof top wind speed ($V_R$). Therefore, $C_p$ must be negative.

Figure 3:
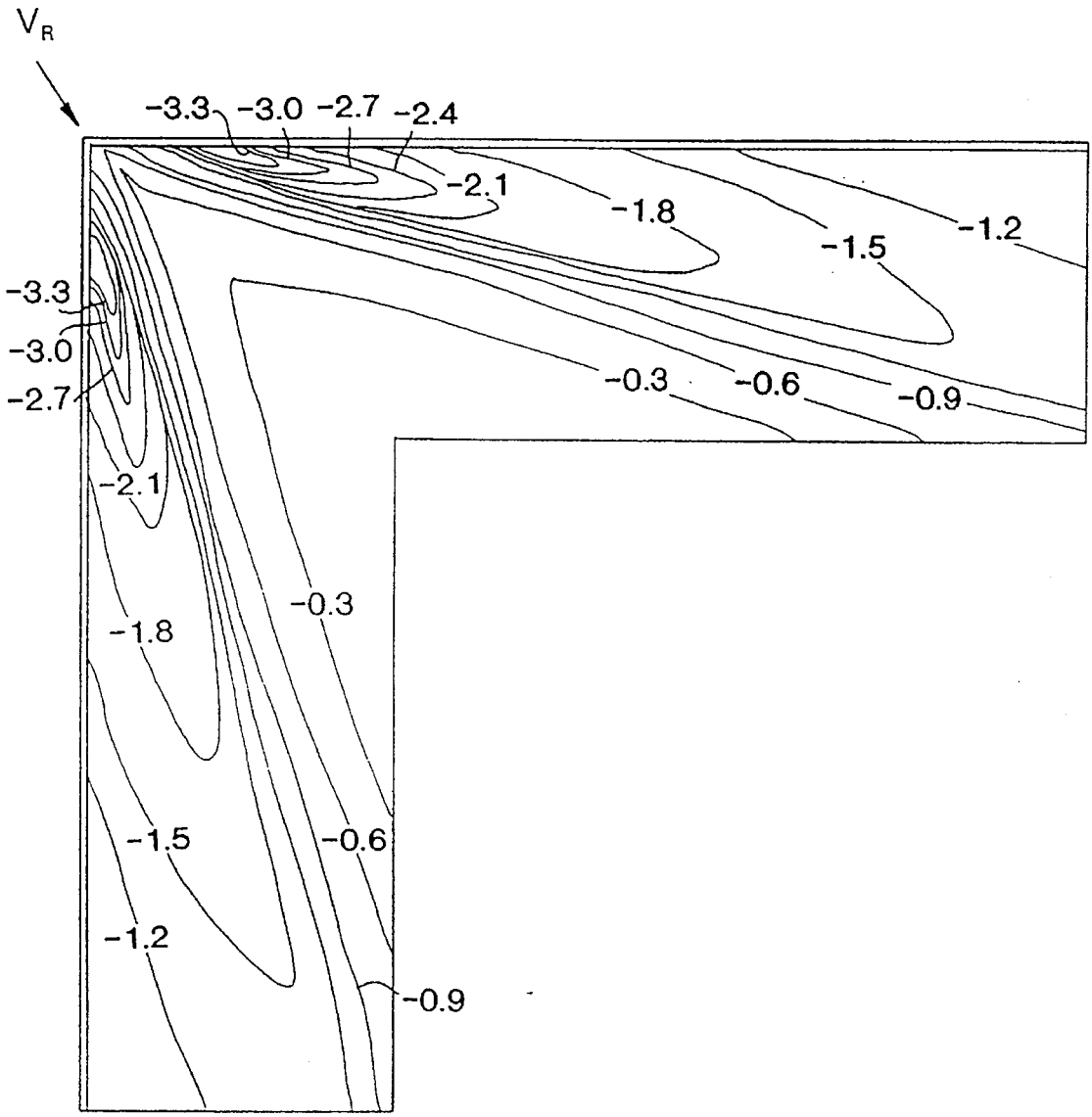
FIG. 3 is a graphical presentation of the external pressure distribution above a corner of a flat roof.

It has been recognized that the maximum coefficient of $C_p$ occurs when the wind impinges at 45° relative to the roof as shown in FIG. 3. The maximum coefficient of pressure is about −3 to −3.3 for a roof without parapets.

Parapets lower the maximum coefficient of pressure (e.g., maximum −2.5). However, while the coefficient of pressure is lowered, the area influenced by the new maximum pressure is increased. The force on the membrane could be actually higher for a roof with parapets. Factors included in determining the force are the height of the parapets and the surface area of the roof.

Critical Pressure Points on a Membrane Roof

Typical pressures in four areas have to be determined before determining the pressure differential acting on the membrane 16. The pressures that need to be identified are the external pressure ($P_R$) associated with roof top wind speed ($V_R$), the pressure in the interior of the building structure 10 ($P_I$) underlying the membrane 16, the roof surface pressure ($P_S$) associated with the roof surface wind speed ($V_S$), and the pressure on top of the membrane ($P_M$). The pressure on top of the membrane ($P_M$) would equal the roof top surface pressure ($P_S$) if the membrane did not have an intervening layer such as ballast 22 or the air permeable and resilient mat 24.

The pressure on the interior of the structure 10 ($P_I$) would be equal to the roof top level pressure ($P_R$) if the structure was completely open. If this was the case, the differential pressure would be equal to zero. However, structures 10 are not completely open and more closely resemble an unvented case. In this situation, the internal pressures ($P_I$) equals the roof top flowable air pressure ($P_R$) when there is no wind or before the wind begins to blow. The internal pressure can, in addition, be influenced by the air handling and conditioning system in the building. Air handling system usually places a positive pressure in the structure resulting in a greater pressure differential. If the roof decking 12 were sealed such that no air could penetrate, a vacuum could be created under the membrane 16. This vacuum would contract the uplift. However, due to normal cracks and openings in the deck, the pressure below the membrane 16 is assumed to be equal to the pressure inside the building ($P_I$).

In comparing the pressure at the roof surface ($P_S$) to that at the top of the membrane ($P_M$), Bernoulli's equation can be used. As indicated previously, the wind speed of the roof surface ($V_S$) is larger than the wind speed at the membrane. Therefore, the relationship may be written as $$V_S=kV_M$$

where K is a constant that is less than 1. Therefore, the pressure of the membrane equals the $$P_M=P_S+V_R^2(1-C_P)(1-K^2)\gamma/2g$$

In field test, the constant for the air permeable and resilient mat 24 has been determined to be approximately 0.1. The air permeable and resilient mat reduces the wind velocity passing over the membrane 16 to one-tenth the speed of roof top wind speed ($V_S$).

Theory on Why Air Permeable and Resilient Mat Succeed

While not wishing to be bound by theory, it is thought that the air permeable and resilient mat is successful in reducing uplift of the membrane because: 1) the mat reduces the wind velocity over the membrane, 2) the mat is porous so that any uplift created on the mat is compensated by the weight of the mat, 3) the weight of the mat acts as ballast for the membrane, 4) the surface of the mat creates turbulence over the roof therein disrupting uplift and 5) if there is ballast, the mat limits scouring of the ballast.

Reduce Wind Velocity over the Membrane

In order for the wind to pass over the membrane, the wind must pass through the mat. The mat is comprised of synthetic fibers randomly aligned into a web having significant porous area to allow the wind to pass through the mat. However, the wind as it flows past the fibers are subject to boundary-layer effects resulting in the flow engaging the fibers being zero. The fibers are sufficiently close (35% of the mat is fiber) that while the wind flows through the mat, the speed of the wind passing through the mat is greatly reduced.

By reducing the wind uplift forces acting on the roof surface, the mat reduces the load required for the uplift forces on the building structural components, reducing construction costs.

No Uplift on Mat

As indicated above, the uplift of the membrane is created by the change of pressure (Δp) across the membrane resulting because the velocity under the membrane is substantially zero. The mat having significant porous area between the fibers has essentially the same pressure above and below the mat. Wind gusts are not constant, and therefore, the mat can dissipate the pressure differential overtime, when the velocity of the wind approaches zero.

Mat is Added Ballast

Any additional item added above the membrane on a single-ply ballasted roof places a force on the roof to counteract the uplift. While not the primary purpose of the mat, the mat does add weight (load) to the roof that must be accounted for in the design of the roof. As indicated previously, in a single-ply ballasted roof, the size of aggregate is reduced. The total load added with the mat is less than that with conventional ballasted single-ply roof.

Turbulence

The mat having a porous surface and wind blowing through and across the mat create turbulence. The laminar flow of the wind is converted to turbulent flow. Whereas the laminar flow has a primary vectorial direction which transfers the energy of the wind into reducing the pressure and creating uplift, the turbulent flow has wind vectors in $4\pi$ steradians. The resulting average of all the vectors is a net velocity in any given direction that is less than that found in the laminar flow.

Limit Scouring

In conventional ballasted single-ply roofs, the roof surface wind speed ($V_S$) engages the ballast on primarily one surface. The wind exerts a force on the ballast pushing it in a windward direction. The mat overlying the ballast reduces the wind speed on the ballast which is equal to the roof surface wind speed ($V_S$). In addition, the mat exerts a downward force on the ballast therein creating a larger force (weight) that the wind must move. In addition, the mat adhered to the membrane defines grids which contain the ballast. Therefore, the size of the ballast can be reduced without concern of scouring of the ballast.

Other Benefits of Invention

In addition to protecting from wind uplift and preventing the aggregate ballast from scouring, the air permeable mat has additional benefits. As indicated previously, two other design factors that are considered are 1) impact resistance to weather and other effects and 2) the influence of solar radiation and ultraviolet rays.

The mat is resilient and relatively rigid. These attributes of the mat result in the mat being able to be walked on and returning to its shape without damage to the underlying membrane. In addition, if a person working on the roof drops a tool such as a wrench, hammer, the impact of the tool will not damage the underlying membrane. Likewise, a sharp object such as a knife or a screw driver will not make contact with the membrane and possible puncture the membrane.

Weather-related damage that have been a concern for flat roofs include items such as wind blow debris including sheet metal, such as from ventilators and air conditioner units, and tree branches blowing across the roof and puncturing the membrane. Another weather-related concern for a membrane roof is hail hitting the membrane puncturing the membrane weakening the adhesive bonds between the membrane and the substrate. In addition in the case of certain rigid insulation, the hail damages the insulation underlying the membrane by permanently compressing the insulating cells. The mat protects the membrane from both kinds of weather related damage discussed, along with other weather-related damage.

The membrane when exposed to ultra-violet rays of the sun deteriorates molecularly. One of the primary purposes of the gravel on the built-up roof is to prevent the ultra-violet rays from hitting the felt and bitumens of the built-up roof. The same benefit is achieved by the mat.

The mat also can be colored to provide radiation benefits by reducing heat load. In addition, if the roof is visible, the mat can be colored for aesthetic purposes. Another benefit is the additional insulation value of the mat.

Other Preferred Embodiments

Figure 4:
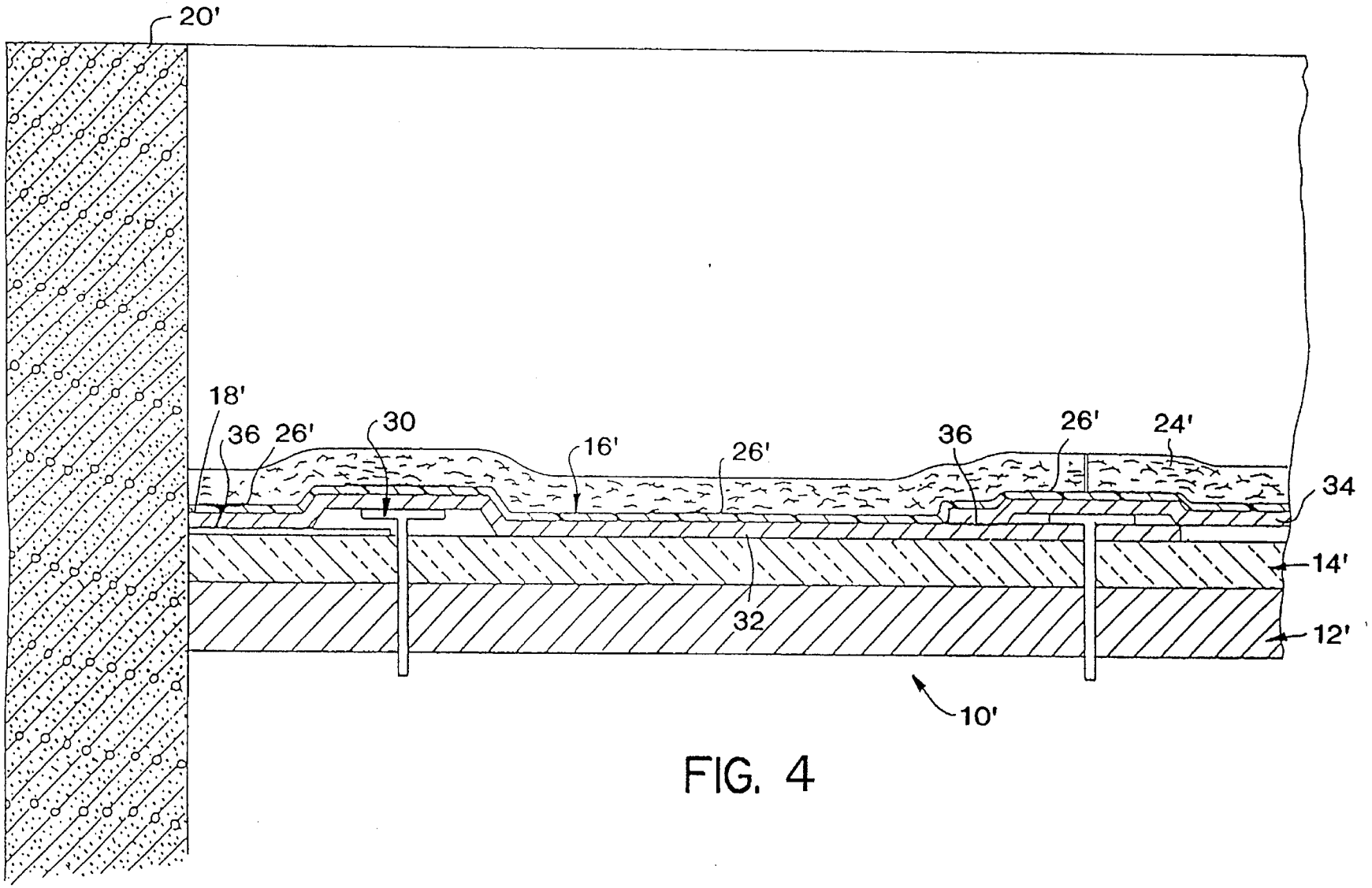
FIG. 4 is a cross-sectional view of a roof of an alternative embodiment of a mechanical affixed single-ply roof.

An alternative embodiment of a single-ply roof mechanically affixed is shown in FIG. 4. The roof structure 10' has a roof deck 12', an insulation layer 14' overlying the roof deck 12'. The roof structure 10' has a single-ply membrane 16' overlying the insulation 14'. The membrane 16' is secured at the periphery 18' in proximity to a parapet 20'. In addition, the membrane 16' is secured to the decking 12' by a plurality of fasteners 30 at designated points to secure the insulation 14' and membrane 16' to the decking 12'. The fastener 30 is secured to the underside of the membrane 16'. Typically the fastener 30 is located at a joint location 30 where the single-ply membrane 16' is formed by joining two sheets together. The sheets are bonded together by heat welding, solvent welding or adhesives to form a larger sheet if required to cover the entire roof. The fastener 30 penetrates through an underlying sheet 32 and adheres to an overlying sheet 34. The sheets 32 and 34 are welded or adhered together at joint 36 such that the fastener 30 is underlying the continuous single-ply membrane 16'. The above construction is conventional and well known.

The roof 10' of the preferred embodiment has an air permeable and resilient member 24' overlying the membrane 16'. The air permeable and resilient member 24', similar to the first embodiment, is a non-woven air permeable and resilient mat made of synthetic fibers (usually nylon, PVC, or polyester) which are open and blended, then randomly aligned into a web by air flow. The web is treated with binding agents of water based phenolics and latexes. The treated web is then oven cured to bind the fabric into relative rigid mats having sufficient porous areas between the random fibers. In the preferred embodiment, the mat 24' has a thickness of ⅜ of an inch. The mat 24' comes in rolls 78 inches wide and 20 yards long. The mat 24' weighs 11.11–13.89 pounds per square and has a fiber percentage of between 35 and 45 percent.

The air permeable and resilient mat 24' is secured to the roof 10' by placing an adhesive or neoprene cement or other comparable adhesive 26' in a 3 inch strip around the periphery of the mat and a 3 inch strip down the center line of the length of the mat 24'. The mat 24 is secured to the membrane 16' to prevent the mat 24' from being pushed across the roof 10.

Figure 5:
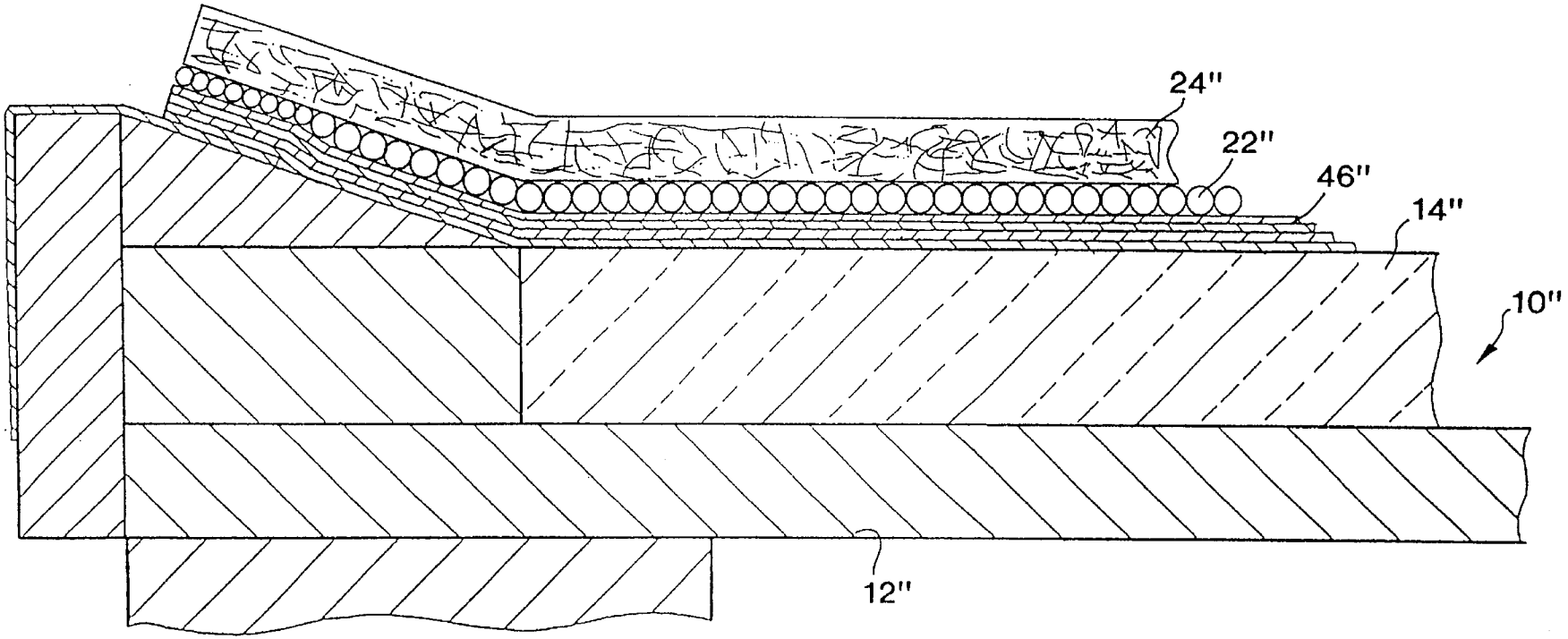
FIG. 5 is a cross-sectional view of a roof of an alternative embodiment of a built-up roof system.

Another preferred embodiment having a built-up roof 10" without a parapet is shown in FIG. 5. The roof structure 10" has a roof decking 12". The roof structure 10" has an insulation layer 14" or plurality of insulation layers. The insulation layer 14" overlies the roofing deck 12" and is laid on the decking 12" and is secured by mechanical fasteners. The roof structure 10" has a built-up membrane 46" comprising layers of roofing felt interposed with bituminous (roofing asphalt). The top layer of bitumen may or may not receive a layer of gravel aggregate 22" at a ratio of 200 pounds to 60 pounds square asphalt. The roof structure 10", in addition, may have 200 pounds per square of gravel of ¼ to ⅜ of an inch diameter on top. The above construction is conventional and well known.

The roof 10" has an air permeable and resilient mat 24" overlying the aggregate 22" or roof membrane 46". The air permeable and resilient mat 24" in the preferred embodiment is a non-woven air permeable and resilient mat made of synthetic fibers (usually nylon, PVC or polyester) which are open and blended, then randomly aligned into a web by air flow. The web is treated with binding agents or water based phenolics and latexes. The treated web is then oven cured to bind the fabric into relatively rigid mats having a significant porous area between the random fibers. The mat 24" has a thickness of ¾ of an inch and comes in rolls 78 inches wide and 34 yards long. The mat 24" weighs 31.25 pounds per square and has a percent open area of 71.43.

The air permeable and resilient mat 24" is secured to the roof 10" using a suitable adhesive in the same method described in the first embodiment. An alternative method is to place a plurality of pavers 48 on the roof 10" underlying the mat 24" and secure the mat 24" to the pavers 48.

Figure 6:
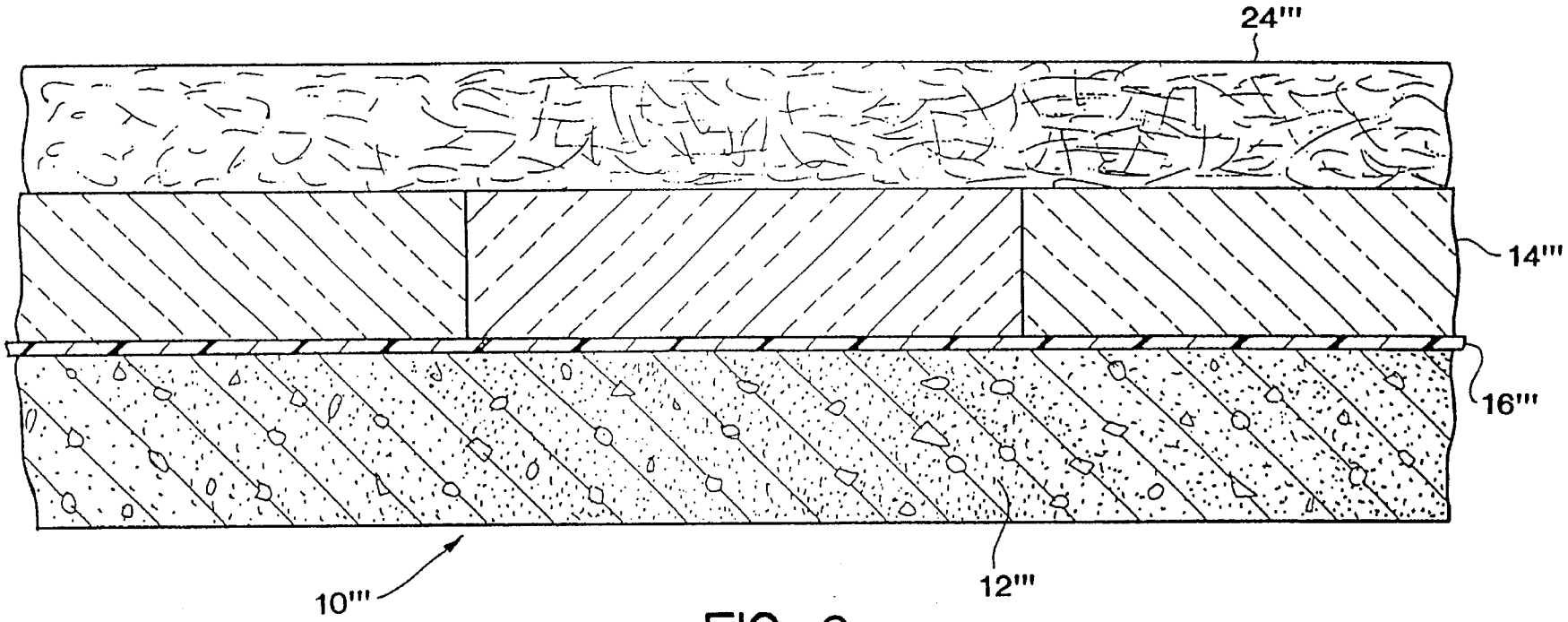
FIG. 6 is a cross-sectional view of a roof of an alternative embodiment of a roof system called an "upside-down" roof.

FIG. 6 shows an alternative embodiment of an "upside-down" roof 10''', a roof where the insulation layer is on top of the membrane 16''' The roof structure 10''' has a roof decking 12'''. FIG. 6 shows the roof decking 12''' formed of concrete; the roof decking 12''' can also be formed of wood, corrugated steel, gypsum and other suitable materials. The roof structure 10''' has a single-ply membrane 16''' overlies the roof decking 12'''. The single-ply membrane 16''' is secured at the periphery of the roof deck 12''', not shown. The single-ply membrane 16''' is not secured except at the periphery 18 and simply overlies the roof deck 12'''. The single-ply membrane 16''' is formed in sheets. The sheets are bonded together by heat welding, solvent welding or adhesives, to form a larger sheet if required to cover the entire roof.

Overlying the membrane 16''' is an insulation layer 14''', or plurality of insulation layers. The insulation layer 14''' is secured by an adhesive fastener to the underlying membrane 16'''. The above construction is conventional and well known.

The roof 10''' has an air permeable and resilient mat 24''' overlying the insulation layer 24'''. The air permeable and resilient mat 24''' is similar to those described in the other embodiments. The air permeable and resilient mat 24" is secured to the roof 10" using neoprene or another suitable adhesive to the insulation layer 24'''. An alternative method is to place a plurality of pavers on the roof 10" underlying the mat 24" and secure the mat 24" to the pavers.

The present invention may be embodied in other specific forms without departing from the spirit or central attributes thereof and, accordingly, reference should be made to the dependent claims, rather than to the foregoing specification, as indicating the scope of the invention.

I claim:

1. A method of reducing uplift on a roof resulting from a wind blowing over the roof at a rooftop wind speed creating a pressure differential, comprising the steps of:

providing a roof having a membrane;

installing a ballast layer comprising loose aggregate prior to installing an air permeable and resilient mat; and installing the air permeable and resilient mat constructed of randomly aligned fibers which are joined by a binding agent, over the membrane, and overlying the aggregate, the mat having openings of a size to reduce the wind velocity over the membrane from that of rooftop wind speed reducing the scouring of the aggregate across the roof while the openings being of a size that the mat is not lifted by the pressure differential therein reducing uplift on the membrane.

2. A method of reducing uplift on a roof resulting from a wind blowing over the roof at a rooftop wind speed creating a pressure differential, comprising the steps of:

providing a roof having a membrane;

installing a ballast layer having a loose aggregate;

clearing away the aggregate from the membrane in specific segments; and securing an air permeable and resilient mat to the specific segments using an adhesive means, the mat having openings of a size to reduce the wind velocity over the membrane from that of rooftop wind speed while the openings being of a size that the mat is not lifted by the pressure differential therein reducing uplift on the membrane.

3. A method of reducing uplift on a roof as in claims 1 or 2 wherein the air permeable and resilient mat is constructed of randomly aligned synthetic fibers which are open and blended, randomly aligned into a web by an airflow, joined by phenolic and latex binding agents and heat cured to produce a varying mesh.

4. A roof structure comprising:

a roof decking;

a membrane;

means for securing the membrane to the roof decking; and an air permeable and resilient mat constructed of randomly aligned fibers overlying the membrane, the mat having openings of a size to reduce the wind velocity over the membrane while the openings being of such a size that the mat is not lifted, the fiber content by area of the mat less than 45 percent of the mat.

5. A roof structure as in claim 4 wherein the membrane is a single-ply membrane.

6. A roof structure as in claim 4 wherein the membrane is a multi-ply built-up roof.

7. A roof structure comprising:

a roof decking;

a single-ply membrane;

aggregate overlying the membrane for securing the membrane to the roof decking; and an air permeable and resilient mat overlying the membrane and the aggregate, the aggregate loosely retained between the membrane and the mat, the mat having openings of a size to reduce the wind velocity over the membrane while the openings being of such a size that the mat is not lifted.

8. A roof structure as in claims 4, 5, 6 or 7 further comprising an insulation between the roof decking and the membrane.

9. A method of reducing scouring of an aggregate on a roof comprising the following steps:

providing a membrane roof over a deck, the roof having a layer of aggregate loosely placed on the membrane;

installing an air permeable and resilient mat over the aggregate for reducing the wind velocity over the aggregate and applying a force to the aggregate.

10. A method of reducing scouring of aggregate on a roof as in claim 9 wherein the membrane is a single-ply and the aggregate is a ballast.

11. A method of reducing scouring of aggregate on a roof as in claim 9 wherein the membrane is a multi-ply built-up layer and the aggregate is a gravel.

12. A method of reducing scouring of aggregate on a roof comprising the following steps:

providing a membrane roof over a deck, the roof having a layer of aggregate;

clearing the aggregate from the membrane in a specific pattern;

installing an air permeable and resilient mat over the aggregate by an adhesive to the cleared specific pattern on the membrane for reducing the wind velocity over the aggregate and retaining the aggregate with the specific pattern.

13. A method of reducing scouring of aggregate on a roof as in claim 12 wherein the step of clearing the aggregate further comprises the step of clearing a grid of aggregate from the membrane the size of the air permeable and resilient mat and clearing a center line of aggregate from the membrane running the long direction of the mat.

14. A method of reducing scouring as in claim 9 wherein the air permeable and resilient mat has a fiber content of approximately 35 percent.

* * * * *